US010849414B2

(12) United States Patent
Vrtaric

(10) Patent No.: US 10,849,414 B2
(45) Date of Patent: Dec. 1, 2020

(54) VOLUMIZING BRUSH

(71) Applicant: Kevin Vrtaric, Yardley, PA (US)

(72) Inventor: Kevin Vrtaric, Yardley, PA (US)

( * ) Notice: Subject to any disclaimer, the term of this patent is extended or adjusted under 35 U.S.C. 154(b) by 572 days.

(21) Appl. No.: 15/643,200

(22) Filed: Jul. 6, 2017

(65) Prior Publication Data

US 2019/0008267 A1 Jan. 10, 2019

(51) Int. Cl.
*A46B 5/00* (2006.01)
*A46B 9/02* (2006.01)

(52) U.S. Cl.
CPC ..... *A46B 5/0037* (2013.01); *A46B 9/023* (2013.01); *A46B 2200/104* (2013.01)

(58) Field of Classification Search
None
See application file for complete search history.

(56) References Cited

U.S. PATENT DOCUMENTS

| | | | |
|---|---|---|---|
| 1,621,269 A | 3/1927 | Stansfeld | |
| 2,685,292 A | 8/1954 | Louis | |
| 3,172,139 A | 3/1965 | Wire | |
| 3,886,619 A | 6/1975 | Natman et al. | |
| 4,008,726 A | 2/1977 | DiGiuseppe | |
| 4,030,158 A | 6/1977 | Blair et al. | |
| 4,475,563 A | 10/1984 | Martin | |
| 4,574,416 A | 3/1986 | Stewart et al. | |
| 5,657,775 A | 8/1997 | Chou | |
| 5,715,847 A | 2/1998 | Rolf et al. | |
| 5,894,849 A | 4/1999 | Ehlhardt et al. | |
| 5,906,023 A | 5/1999 | Edwards | |
| 6,006,395 A | 12/1999 | Tiramani et al. | |
| 6,308,717 B1 | 10/2001 | Vrtaric | |
| 6,595,219 B2 | 7/2003 | Anderson | |
| 8,353,076 B1 | 1/2013 | Asta | |
| 8,857,005 B2 | 10/2014 | Shim et al. | |
| 2016/0157593 A1* | 6/2016 | Sze | A46B 3/005 15/160 |

FOREIGN PATENT DOCUMENTS

WO 2013119488 A1 8/2013

OTHER PUBLICATIONS

BeFri Hair Brush. www.nanokeratinsystem.us/befri-brush; Amir Segev.
http://www.hairflex.com/about.htm; Hairflex, George Caroll.

* cited by examiner

*Primary Examiner* — Brian D Keller
(74) *Attorney, Agent, or Firm* — David Postolski, Esq.; Gearhart Law LLC

(57) ABSTRACT

A hair brush apparatus comprises a handle, an outer frame extending from the handle, and an inner frame, each with proximal and distal ends. Each of the outer frame and the inner frame includes a plurality of parallel prongs with ends and channels that are disposed in alternating arrangement, whereby the outer and inner frame prongs are interleaved together. A suspension assembly comprises a base suspension member attaching the outer frame proximal end to the inner frame proximal end. At least one prong suspension member attaches at least one inner frame prong end to at least one outer frame channel. The suspension assembly enables relative movement of the inner frame with respect to the outer frame in at least two axes, selected from a longitudinal, lateral and transverse axis. A control member can be used to manipulate the movable inner frame in any direction as desired by the user.

19 Claims, 9 Drawing Sheets

VOLUMIZING BRUSH

BACKGROUND

This disclosure relates to the field of hair brushes, and specifically a non-cylindrical hair brush with bristles that can provide relative movement of hair bristles in more than one direction for grooming and hair styling. Some of the bristles may be fixed on a stationary frame and other bristles are disposed on a movable frame that is flexibly attached thereto, with the movement controlled by a user and/or hair stylist to enable such user with the ability to de-tangle hair and volumize hair with ease.

Using hair brushes for grooming, detangling, volumizing and styling is well known. Numerous hair brushes exist and perform specific tasks that are achieved in a variety of ways. Some brushes have used a combination of flexible and stationary parts with bristles attached thereto. Some have even disclosed having flexible hinges or springs as connectors to allow movement of a flexible component relative to a stationary component. However these brushes have a common problem, they are only designed to move in one plane relative to the stationary frame, either parallel or perpendicular, but not both directions, and further do not move in all three dimensions.

There remains a need for a hair brush having a frame that can move freely in more than one direction, more particularly in axes that are both parallel and perpendicular to a stationary frame so a user can more easily style, de-tangle and volumize hair. There is further a need for a hair brush having one or more connectors, disposed between the movable and stationary frames, which allow for such three dimensional movement of one frame relative to the other while providing a durable hair brush for ease of de-tangling, volumizing and styling use. There is still further a need for a hair brush made of a flexible material, or any part thereof, to allow for flexibility and resilience for repeated use over time.

SUMMARY

In one embodiment, the present disclosure is directed to a hair brush apparatus comprising a handle, an outer frame extending from the handle and including proximal and distal ends, a plurality of parallel prongs each having a plurality of bristles disposed thereon and terminating at a free end and a plurality of channels each having a closed end defining a well. Each of the prongs and channels disposed in alternating arrangement. An inner frame has corresponding proximal and distal ends. The inner frame similarly comprises a plurality of prongs, each with a respective free end, and a plurality of channels, each with a respective closed end that defines a well, which prongs and channels are also disposed in an alternating arrangement. The outer frame prongs are interleaved with the inner frame prongs. A suspension assembly comprises a base suspension member attaching the outer frame proximal end to the inner frame proximal end and at least one prong suspension member attaching at least one inner frame prong end to at least one outer frame well. The suspension assembly provides for relative movement of the inner frame with respect to the outer frame in at least two axes of movement.

Another aspect of the present disclosure includes a control member disposed at the inner frame proximal end. The control member preferably has a user receiving surface for manipulating movement of the inner frame. At least one base suspension member attaches the control member to the outer frame. In a further aspect, two base suspension members may attach the control member. The control member may be selected from various structures that permit ease of actuation by the user such as, but not limited to, a protrusion, a protruding lever, a button, a contoured surface, a recess or concave surface and other structures which provide a touchable surface for the user to locate easily and/or any combinations of any of the foregoing structures.

A further aspect of the present disclosure the suspension assembly enables relative movement of the inner frame along the longitudinal and lateral axes, and even more further enables relative movement of the inner frame along two or more axes selected from the longitudinal, lateral an transverse axes. The inner frame is movable between a first position at which the inner frame is normally held biased by the suspension assembly to at least one second position at which an external, user supplied, force is applied upon the control member. The user may repeatedly move the inner frame as desired for as many times as desired to achieve whatever desired hair styling end result.

In a still further aspect of the disclosure, at least one of the inner frame, outer frame and the suspension assembly is made of a material selected from plastic, wood or metal and, further made be selected from a thermoplastic elastomer such as TPE.

In a yet further aspect of the disclosure, the base suspension member and/or the prong suspension members may be selected one of a spiral-shaped spring, a U-shaped flexible hinge, an S-shaped flexible hinge and one or more substantially circular-shaped flexible sections.

In another aspect of the disclosure, the outer frame distal end includes at least two wells that are attached to an inner frame prong end by at least one suspension member. More specifically, the outer frame distal end includes three wells each with a corresponding inner frame prong end attached thereto. Similarly, in a further aspect, the inner frame proximal end includes at least two wells that are attached to a corresponding outer frame prong end by at least one suspension member. Moreover, a middle portion of the inner frame is free attachment to the outer frame along the inner frame that extends between the inner and outer prong ends so as to exclude any attachment by any suspension assembly members along such middle portion.

In a still further aspect of the present disclosure, a hair brush apparatus is provided having one or more of the previously described aspects in any combination thereof.

In another aspect of the present disclosure, a method for styling hair is provided. Such method comprises a providing a hair brush having one or more of the above described aspects in combination with the following steps of: providing a first position of the inner frame relative to the outer frame at which the inner frame is normally biased by the suspension assembly without a user applied force; pressing, with a user applied force, the control member to move the inner frame relative to the outer frame in at least two axes selected from a longitudinal axis, a lateral axis and a transverse axis to at least one second position; releasing the control member to return to the first position; and repeating the pressing step one or more times to achieved the desired styling effect on the hair.

BRIEF DESCRIPTION OF THE DRAWINGS

The following drawings form part of the present specification and are included to further demonstrate certain aspects of the present disclosure. The disclosure may be better understood by reference to one or more of these drawings in combination with the detailed description of specific embodiments presented herein.

DETAILED DESCRIPTION

The present disclosure is directed to a hair brush apparatus which will be described with various features either in combination or in the alternative. Such description is intended to be exemplary and not exhaustive of all the possible variations covered by the present disclosure.

Figure 1:
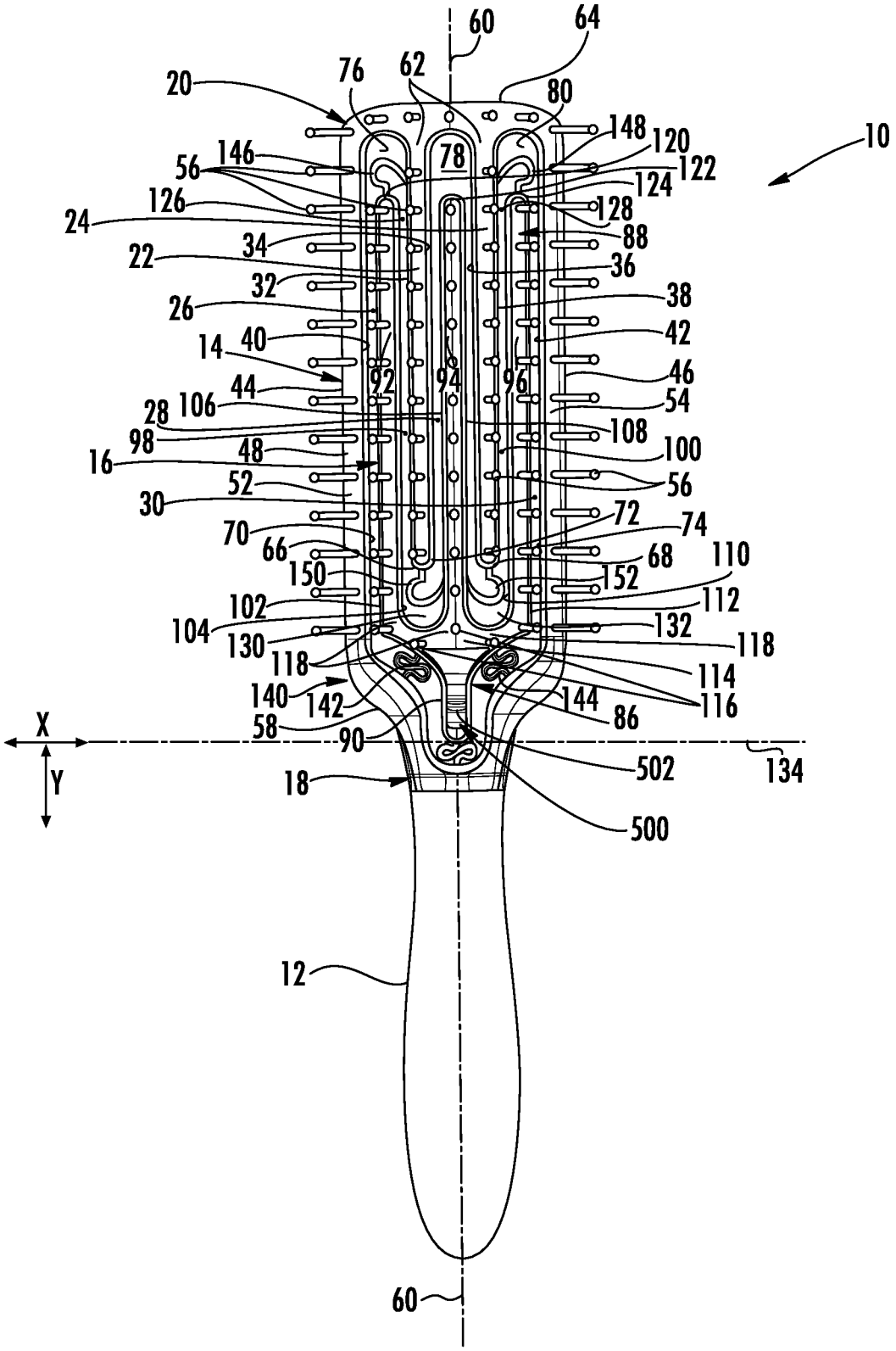
FIG. 1 is a plan view of the hair brush in accordance with one embodiment of the present disclosure showing the hair brush and its component parts.
Figure 2:
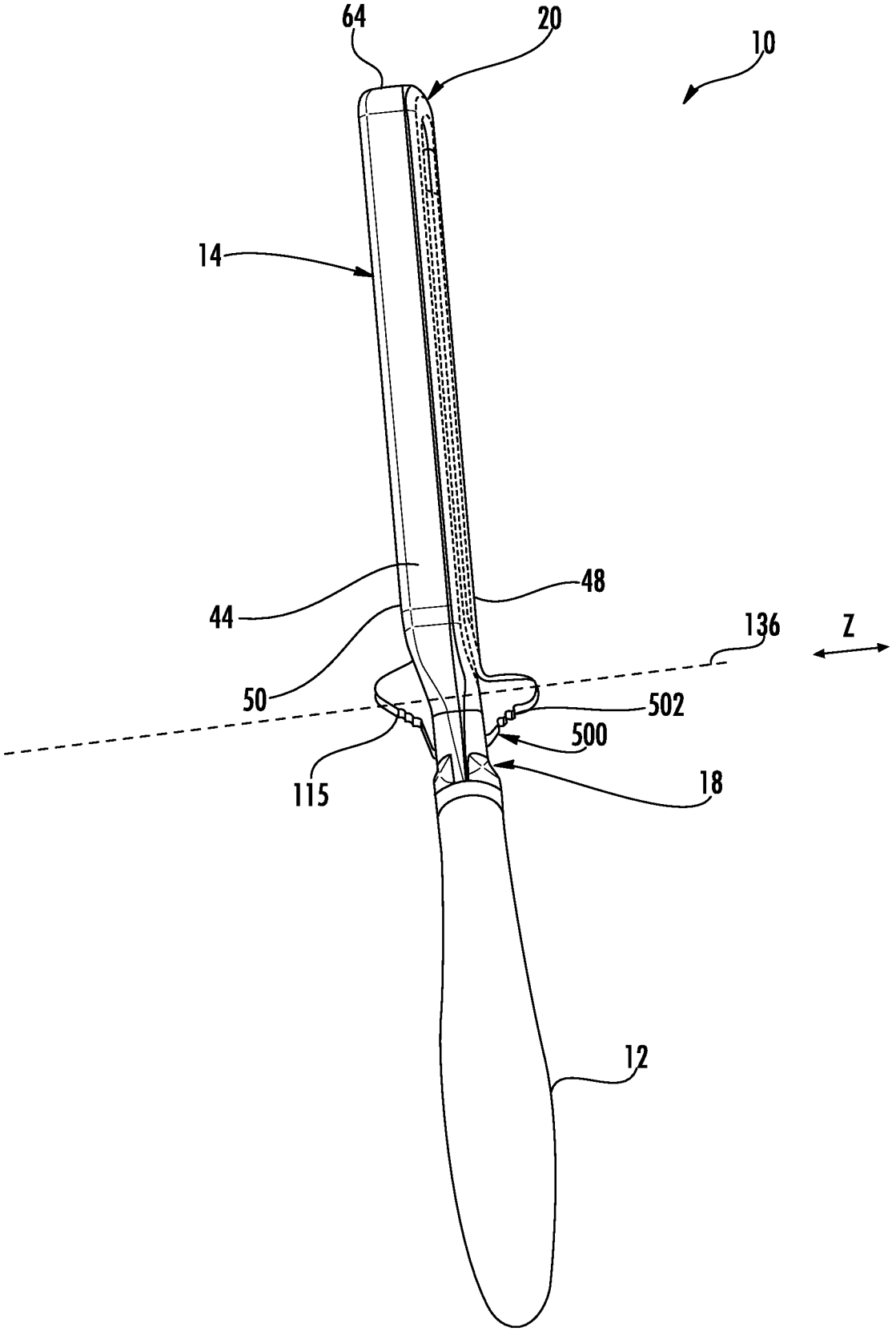
FIG. 2 is a side elevation view of the hair brush of the first embodiment of the present FIG. 1 (with portions such as bristles shown removed) which includes a control member comprising a protruding lever.

With reference to FIGS. 1 and 2, a first embodiment of the hair brush apparatus, generally at 10, comprises a handle 12, an outer frame, generally at 14, and an inner frame, generally at 16. The outer frame 14 includes an outer frame proximal end, generally at 18, attached to the handle 12 and an outer frame distal end, generally at 20, that is opposite the handle.

As seen in FIGS. 1-2, the structure of the outer frame comprises a plurality of parallel prongs, 22, 24 and a plurality of channels, 26, 28, 30. Each prong 22, 24 is defined by corresponding prong side edges 32, 34, 36, 38 (shown in FIG. 1). The outer frame 14 further having an interior side edges 40, 42 and exterior side edges 44, 46, with adjacent interior and exterior side edges 40, 42, 44, 46 forming parallel bridges 52, 54 on each side of the outer frame. FIGS. 1-2 also show opposed front 48 and back 50 surfaces (with only front surface being shown in FIG. 1) of the outer frame 14. An outer frame bottom surface 58 extends between interior side edges 40, 42 and may be contoured or tapered towards the handle 12, as shown in FIG. 1.

As further shown in FIGS. 1-2, each of the outer frame prongs 22, 24 and bridges 52, 54 having a plurality of bristles 56 disposed thereon and generally extend outwardly therefrom. The bristles may also be generally parallel to form rows, although other bristle configurations are also possible. The bristles 56 may be extend from the front surface 48 either perpendicularly or at angle other than 90 degrees relative to a longitudinal axis 60, whereupon the bristles may angle either inwardly, e.g., toward the longitudinal axis 60 of the hair brush at an angle less than 90 degrees, or alternately, may extend outwardly, e.g., away from the longitudinal axis at an angle greater than 90 degrees, based on whatever styling technique is desired to be performed by the user on the hair. The bristles may also be of various different heights. By way of example in FIG. 1, the rows of bristles 56 on the bridges 52, 54 are angled outwardly or away from the longitudinal axis 60, at angle approximately in the range of about 90-120 degrees. By way of example, FIG. 1 shows the other interiorly located rows of bristles 56 disposed on the prongs 22, 24 extending from the front surface 48 relative to the longitudinal axis 60 at a lesser angle, within an approximate range of 90-115 degrees. In this way, the outwardly and inwardly located bristles form a generally fan-shaped orientation relative to the cross-sectional width of the hair brush. With regard to such bristle positioning, other shapes, orientations and combinations of bristle angles are also possible and not limited to the particular examples shown and described herein. Moreover, it is understood that many different bristle shapes, heights and angles are possible either when considering a row of bristles compared to an adjacent row or comparing the individual bristles within any particular row and that such bristle will depending on the hair styling objective that is desired.

As further shown in FIG. 1, each prong 22, 24 extends from a base end 62 that extends from a top surface 64 of the outer frame towards a free end 66, 68. Each parallel prong 22, 24 is inserted between corresponding channels 26, 28, 30 such that the prongs and channels are disposed in an alternating arrangement or orientation relative to each other, with each channel being disposed between two prongs 22, 24 or between one of the prongs 22, 24 and one of the bridges 52, 54. Similarly, each prong 22, 24 is disposed between corresponding channels 26, 28, 30. Each outer frame channel 26, 28, 30 is defined by either by opposing prong side edges 34, 36 or prong side edges 32, 38 that face or oppose the respective interior side edges 40, 42. In FIG. 1, each channel 26, 28, 30 defines an open end 70, 72, 74 and a closed end or well 76, 78, 80 near the outer frame top surface 64. The wells 76, 78, 80 alternate with the prong base ends 62, and effectively separate the wells into different but parallel channels.

Turning back now to the inner frame 16, FIG. 1 also shows an inner frame proximal end, generally at 86, and an inner frame distal end, generally at 88. As seen in FIGS. 1-2, the structure of the inner frame 16 is disposed within or suspended inside the outer frame 14 and attachment therebetween will be described in further detail below so as to enable relative movement between the frames 14, 16. It is understood that other orientations, interposing or placement of the frames relative to each other are also possible without limitation to the embodiments shown and described herein without departing from the scope of the claims.

In FIG. 1, the inner frame proximal end 86 includes a bottom surface 90 that tapers towards the handle 12, which bottom surface will be described in further detail below. Similar to the outer frame 14, the inner frame 16 comprises a plurality of prongs 92, 94, 96 and a plurality of channels 98, 100, which in FIGS. 1-2 are shown in parallel arrangement relative to each other although other arrangements are also possible. Each prong 92, 94, 96 is defined by corresponding side edges 102, 104, 106, 108, 110, 112 (shown in FIG. 1). In FIG. 1, the inner frame 16 has a front surface 114 and opposed back surface (not shown or hidden from view in FIG. 2 except for control member 115) which may be generally coplanar with the outer frame front and back surfaces 48, 50 when disposed in an at rest position without any user applied force. Each of the inner frame prongs 92, 94, 96 having a plurality of bristles 116 disposed thereon and generally extend outwardly therefrom. As previously described above with respect to the outer frame 14, the inner frame bristles 116 may be extend from the front surface 114 either perpendicularly or at any desired angle relative to a longitudinal axis 60, which may be similar or different from the angle of extension and/or height of other bristles depending on what styling technique is desired by the user. By way of example in FIG. 1, the middle parallel prong 96 shows a plurality bristles 116 forming a row with each bristle extending perpendicularly relative to the inner frame front surface 114 whereas the flanking parallel prongs 92, 96 form parallel rows of bristles that are angled away from the longitudinal axis 60, at angle greater than about 90 degrees. In accordance with the previously described aspects of the disclosure, other combinations of bristles 116 orientation are possible for each prong 92, 94, 96 including different angles or heights along each row as a whole or different angles or heights for one or more bristles within each row as well as reoccurring or alternating patterns of such angles and/or heights within a single row.

As further shown in FIG. 1, each inner frame prong 92, 94, 96 extends from a base end 118 near the inner frame proximal end 86. Such prong 92, 94, 96 are parallel and spaced relative to each other towards a corresponding free end 120, 122 124. Each parallel prong 92, 94, 96 and each parallel channel 98, 100 are disposed in an alternating arrangement or orientation relative to each other. In this way, each channel 98, 100 is disposed between two parallel prongs 92, 94, 96 that respectively flank the corresponding channel, with one channel 98 arranged between parallel prongs 92, 94 and another channel 100 arranged between parallel prongs 94, 96. The sides of each inner frame channel 98, 100 are defined by respective opposing prong side edges 104, 106, 108, 110 defining parallel channels separated by the parallel prongs. In FIG. 1, each channel 98, 100 defines an open end 126, 128 near the prong free ends 120, 122, 124 and a closed end or well 130, 132 near the prongs base ends 118. The wells 130, 132 alternate with the prong base ends 118 along a second or lateral axis 134 that extends across a width of the hair brush. It is understood that the lateral axis 134, which may be arbitrarily referred to as an X-axis, is perpendicular to the first or longitudinal axis 60, which may be arbitrarily referred to as a Y-axis. A third or transverse axis 136, which may be arbitrarily referred to as a Z-axis (as best seen in FIG. 2), extends in the direction of the bristles 56, 116 and such axis is understood to be perpendicular to the first and second, i.e., longitudinal and lateral axes.

The arrangement of the inner and outer frames in FIGS. 1-2 shows the inner frame 16 suspended within the outer frame 14. More particularly, the prongs of one frame are interleaved with the prongs of the other frame in a complementary placement. This interleaving arrangement may be achieved by placing at least one prong of one frame between or adjacent to the prongs of the other frame. As shown more specifically with reference to FIG. 1, inner frame prongs 92, 94, 96 are inserted between or on either side of outer frame prongs 22, 24 and outer frame prongs 22, 24 are inserted between inner frame prongs 92, 94, 96. Furthermore, each inner frame prong 92, 94, 96 is received by the corresponding outer frame channel 26, 28, 30, and, similarly, each outer frame prong 22, 24 is received by the corresponding inner frame channel 98, 100. More particularly, each outer frame prong free end 66, 68 is received within its respective inner frame well 130, 132. Likewise, each inner frame prong free end 120, 122, 124 is received within its respective outer frame well 76, 78, 80.

A suspension assembly, generally at 140, attaches the inner frame 16 to the outer frame 14 to hold the inner frame suspendibly connected within the outer frame. The suspension assembly 140 comprises a base suspension member, which may include at least one base suspension member 142, 144 that attaches the inner frame 16 to the outer frame 14. More preferably, the base suspension member 142, 144 attaches the inner frame proximal end 86 to the outer frame proximal end 18 and allows flexibility of movement therebetween. FIG. 1 shows each base suspension members 142, 144 extending from the inner frame bottom surface 90 towards outer frame 14. One or more base suspension members 142, 144 may be utilized and are not limited to the number and arrangement shown. As shown in FIG. 1, the base suspension member 142, 144 has an undulating shape such as an S-shape or a zig-zag shape or other shape having a flexibility of movement in three dimensions.

In FIG. 1, the suspension assembly 140 further includes at least one prong suspension member 146, 148, 150, 152. As shown in FIG. 1, at least one prong suspension member 146, 148 attaches at least one inner frame prong 92, 94, 96 (attachments to prongs 92 and 96 being shown in FIG. 1) to the respective outer frame well 76, 78, 80 at the outer frame distal end 20 near a top of the apparatus. For those inner frame prongs 92, 94, 96 that are attached, the attachment point of the respective prong suspension member 146, 148 is adjacent the terminating free ends 120, 122, 124 and extends away from (distally relative to FIG. 1) the prong 92, 94, 96 in a desired shape or configuration, described in further detail below, before attaching to the respective well 76, 78, 80. The attachment point of the suspension member 146, 148 to the respective well 76, 78, 80 may be located in the well at a fixed point near the top surface 62 or at a fixed point located on the prong side edge 32, 34, 36, 38 adjacent the respective prong base end 64 or interior side edges 40, 42 provided that such fixed point is attached at a location that is distally beyond the free end 66, 68. By way of example and not limitation, FIG. 1 shows two inner frame prongs 92, 96 respectively attached to outer frame wells 76, 80 at side edges 32, 38, although other attachment points are also possible that allow attachment within the wells 76, 80. It if further possible that each of the prongs 92, 94, 96 may be attached within their respective wells 76, 78, 80, as will be shown and described in further below. Accordingly, at least one such suspension members is utilized and provides an attachment between at least one prong free end and the respective well thereby avoiding other attachments along a middle length of the associated prong. Advantageously, the present disclosure excludes suspension member attachments along opposed facing prong side edges of adjacently situated prongs where the inner and outer frame prongs overlap or are interleaved. A middle portion of each prong or a length disposed between its respective well and free end is thereby free of any suspension member attachment.

As further shown in FIG. 1, at least one prong suspension member 150, 152 may also attach at least one outer frame prong 22, 24 to the respective inner frame well 130, 132 near the bottom of the apparatus. If utilized, such bottom prong suspension member 150, 152 similarly attaches at least one outer frame prong free end 66, 68 to a respective inner frame well 130, 132, whereby such suspension member may have one or more desired configurations described below. Each prong suspension member extends from a fixed attachment point at the respective outer frame prong free end 66, 68 (in a proximal direction in FIG. 1) to a fixed attachment point that is located beyond (and proximally from) the free end and within the inner frame well 130, 132. In FIG. 1, the suspension members 150, 152 are attached within the respective well 130, 132 at side edges 106, 108 although attachment along other points within the associated well are also possible or, alternatively, only a subset of such prongs may be attached to an associated well.

The base suspension members 142, 144 and the prong suspension members 146, 148, 150, 152 may be made of one or more materials. By way of example and not limitation, such material may include a metal, springs, plastic, and the like. Among plastic materials, a thermoplastic elastomer (TPE) may be used, which is a copolymer mixture usually comprising a plastic and a rubber having both thermoplastic and elastomeric properties, which allows flexibility of movement. The base suspension member may be manufactured by various known molding, such as injection molding, processes either separately or in conjunction with one or more other components of the present disclosure. It is further possible that the apparatus and its constituent parts may be molded as single material. Other possible materials include but are not limited to other types of plastic, metal, elastic, fabric, string and/or combinations thereof. Each of the base and prong suspension members 142, 144, 146, 148, 150, 152 may include various constructions such a hinge, spring, telescoping members, sliding members, ball and socket joints as well as others and/or any combinations thereof. The material of the base and prong suspension members advantageously retains the strength and resilience to move from a first or original position to at least one second position and then return to its original form regardless of use over time. The suspension member design and composition thereby creates a brush that can move in all three dimensions without compromising the structural integrity of the brush over time.

Figure 3:
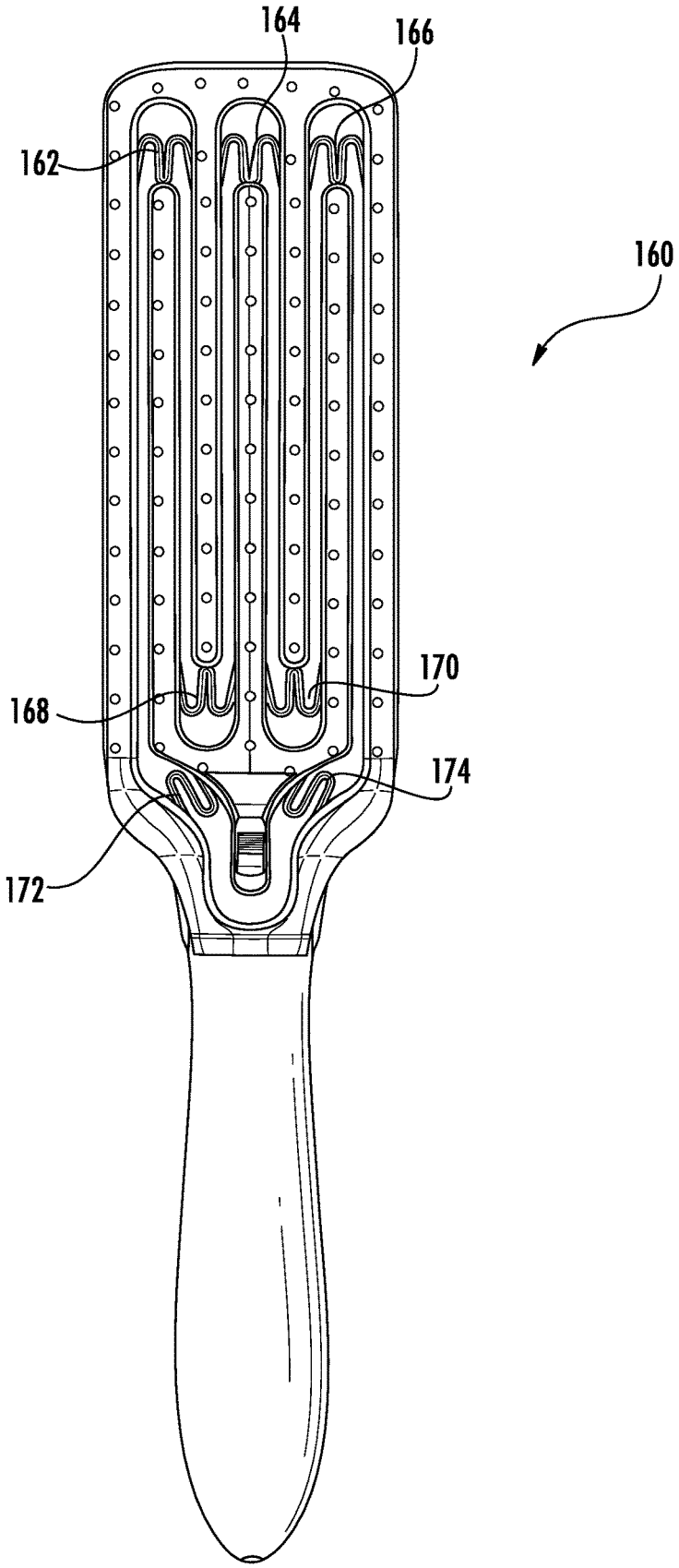
FIG. 3 is a plan view of the hair brush apparatus in accordance with an alternative embodiment of the present disclosure showing alternative suspension assembly.
Figure 5:
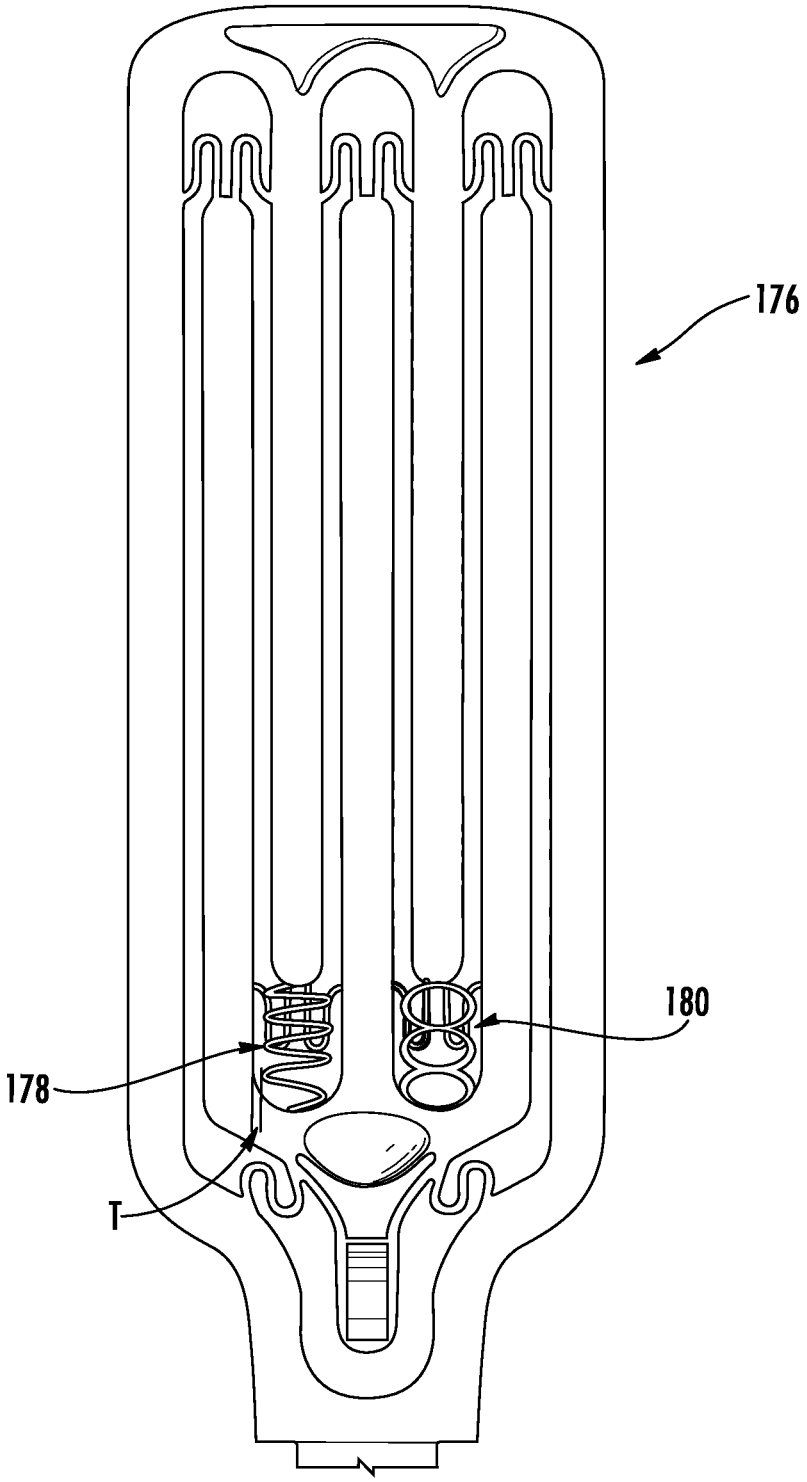
FIG. 5 is an enlarged plan view in accordance with a further embodiment of the present disclosure (with portions of the apparatus removed) showing alternate prong suspension members.
Figure 6:
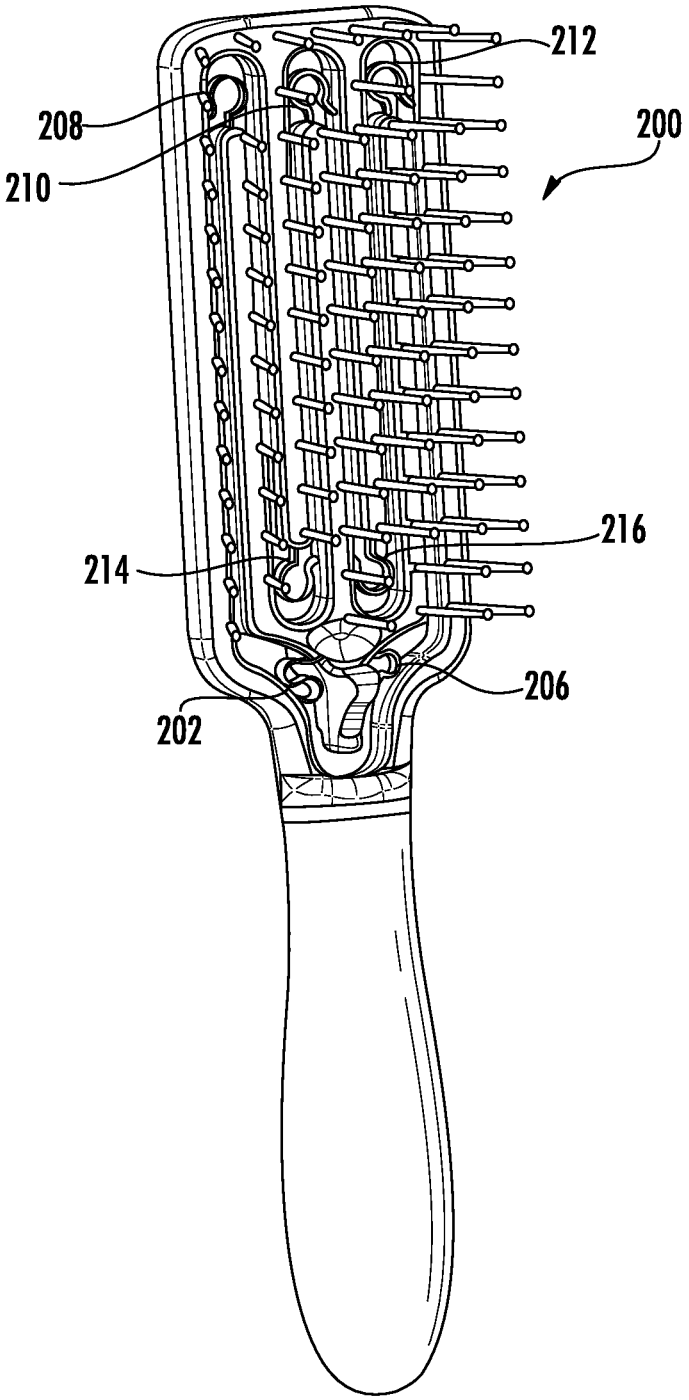
FIG. 6 is a perspective view in accordance with a yet further embodiment of the present disclosure showing a yet further variation of prong suspension members.
Figure 7:
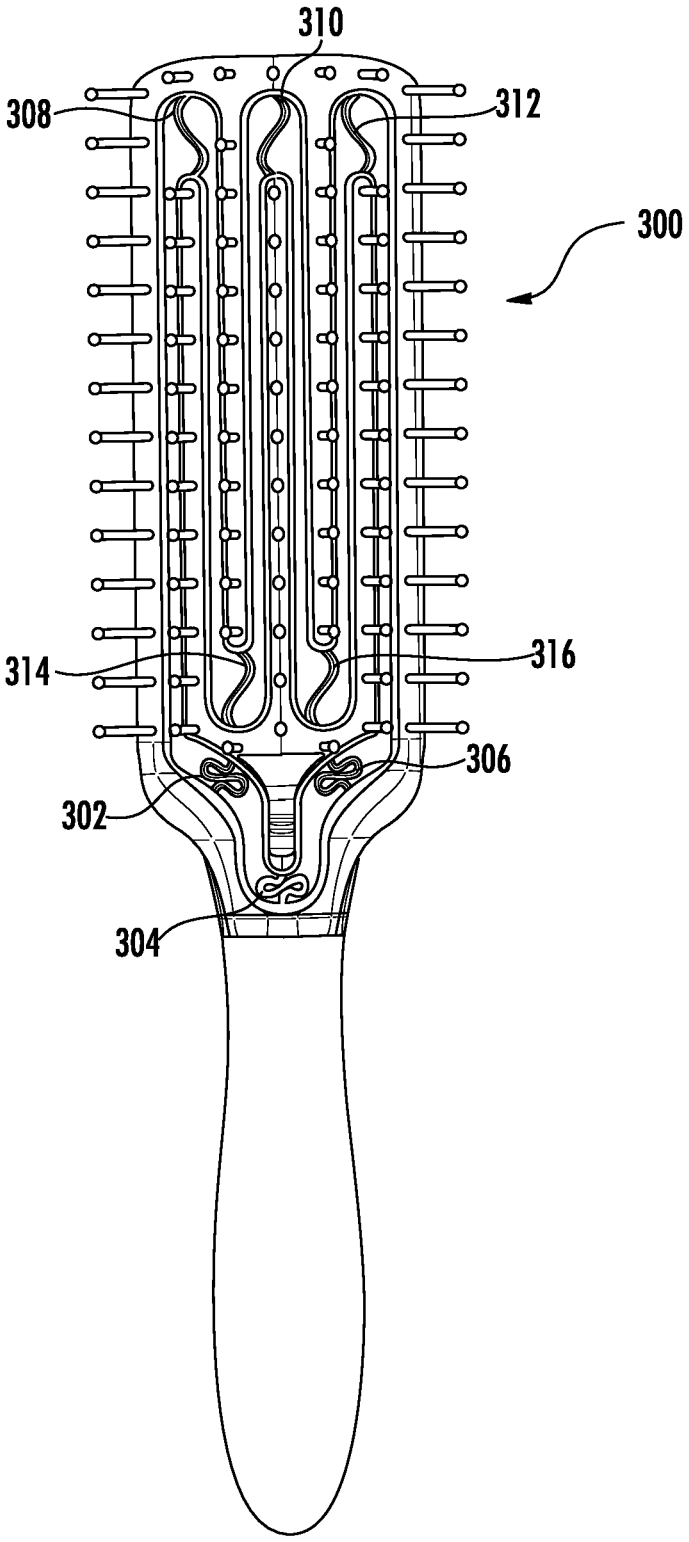
FIG. 7 is a plan view in accordance with another embodiment of the present disclosure showing another combination of prong suspension members.
Figure 8:
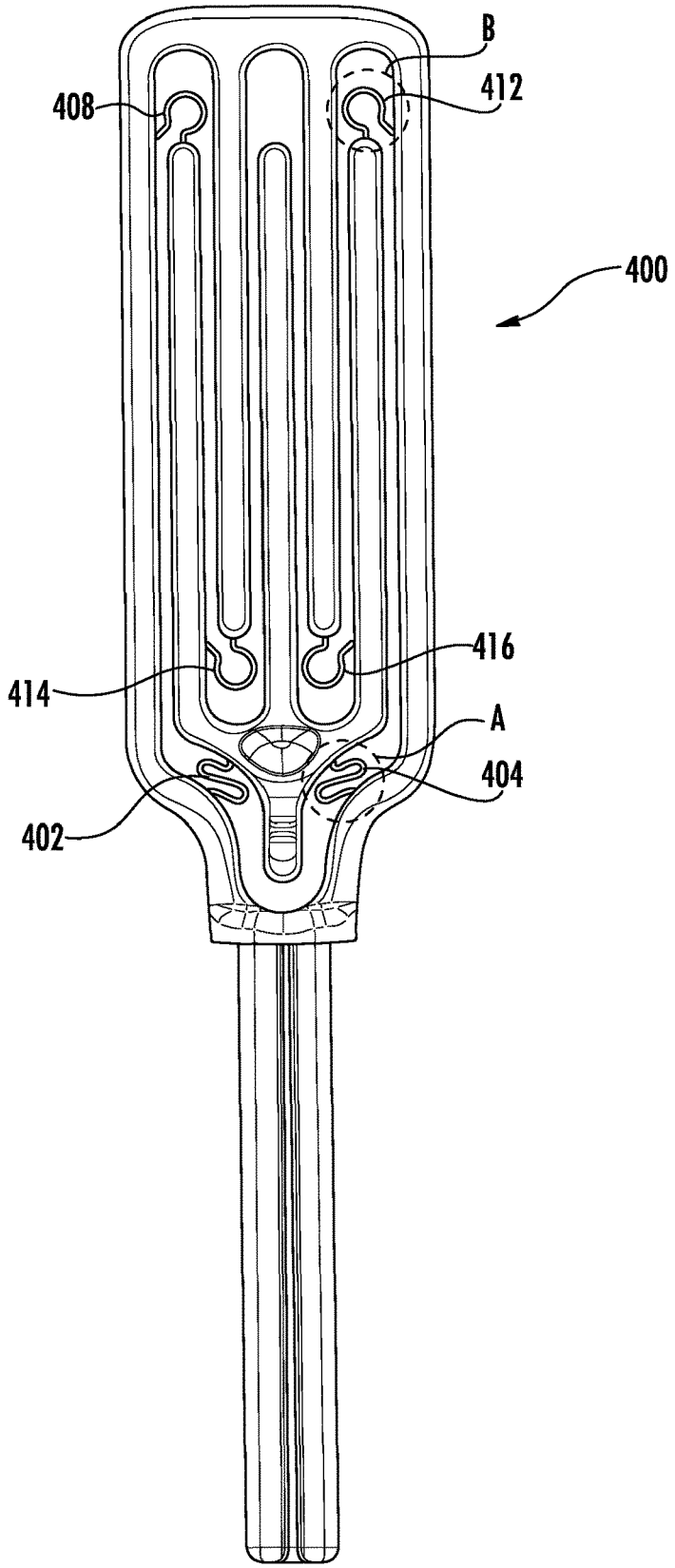
FIG. 8 is a plan view in accordance with an alternative embodiment of the present disclosure (with portions of the apparatus shown removed) showing a still further alternative of prong suspension members.

Examples of other shapes or configurations that provide a flexible design include but are not limited to spiral, curved, circular, substantially circular, semi-circular, looped, elliptical, zig-zag, serpentine, double-helix, and/or other straight or curved shapes, including but not limited to U-shaped, S-shaped, C-shaped, Z-shaped, W-shaped, O-shaped, Y-shaped and/or a "question mark" shaped as well as the other shapes shown and described herein with respect to the alternate embodiments, which will be described below. For example, a second embodiment 160 in FIG. 3 includes an apparatus having each of the inner and outer frame prongs are attached via double U-shaped prong suspension members 162, 164, 166, 168, 170 and serpentine or S-shaped base suspension members 172, 174. FIG. 5 shows an another embodiment of an apparatus 176, similar to FIG. 3, but further shows bottom prong suspension members, generally at 178, 180 having various alternative shapes that are superimposed over each other, including U-shaped, zig-zag and/or spiral, elliptical and S-shaped. FIGS. 6-8 each show further embodiments, generally at 200, 300, 400 having at least one respective base member 202, 206, 302, 304, 306, 402, 404 and at least one respective prong suspension member 208, 210, 212, 214, 216, 308, 310, 312, 314, 316, 408, 412, 414, 416 with various shapes of serpentine or zig-zag, substantially circular and/or S-shaped for the suspension members and variation in the number of the base and prong suspension members. Other combinations are possible with these embodiments being shown by way of examples and not limitation, including, but not limited to, any combination of any one or more of the foregoing suspension member shapes in a single embodiment.

Figure 9:
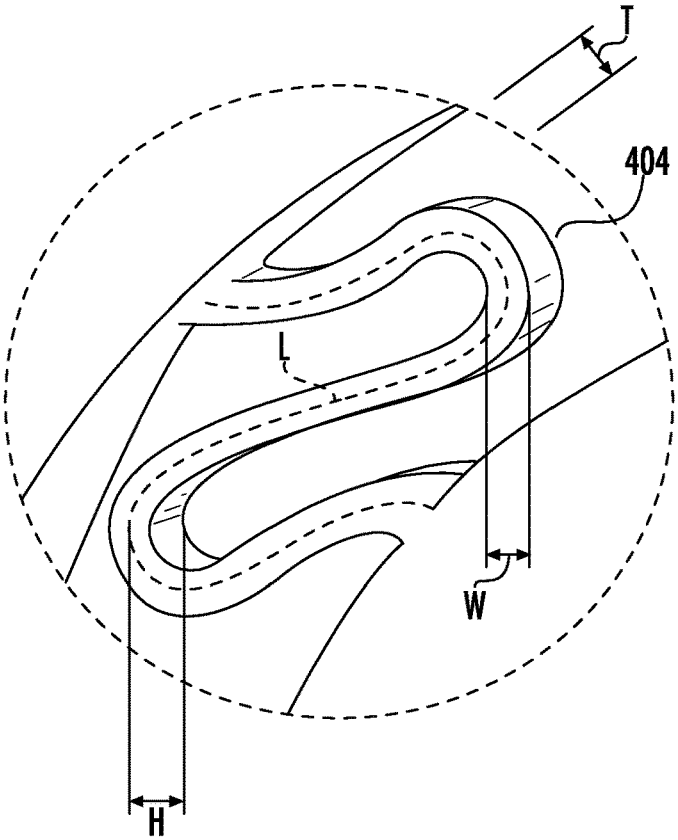
FIG. 9 is an enlarged partial view of section A of FIG. 8.
Figure 10:
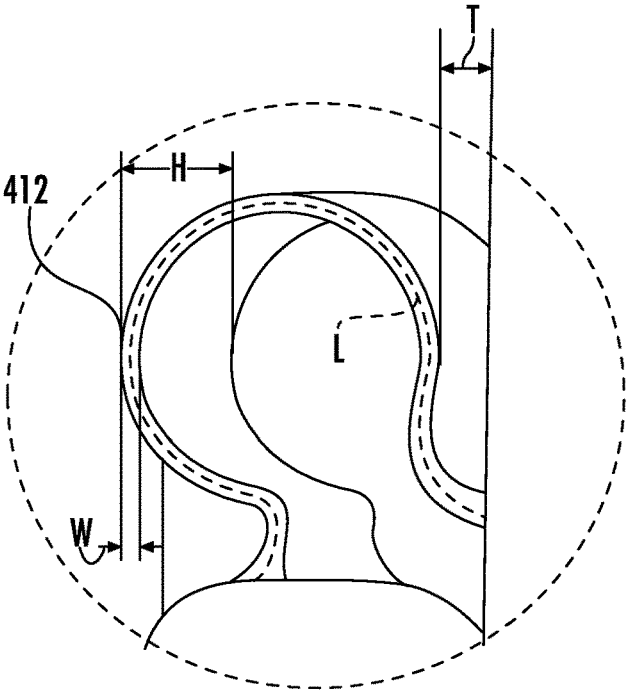
FIG. 10 is an enlarged partial view of section B of FIG. 8.

FIGS. 9-10 shows enlarged base and prong suspension members 404 and 412, which may be illustrative of any of the previously described suspension members in any one of the embodiments discussed herein. In FIGS. 9-10, each of the base and prong suspension members 404, 412 may include a width W and a height H, and a length L. The length of the suspension member may be approximately two to three times the width and/or height so as to allow for greater relative movement and flexibility between the inner and outer frames. Such dimensions of the suspension assembly are preferably selected to give optimal flexibility in three dimensions when acted upon by a user supplied force while still providing resilience, durability and strength for the apparatus. Each of such dimensions may also vary along their extent as desired, such as but not limited to variations in thickness, tapering and the like. By way of example and not limitation, the width W may be provided within a range of approximately 0.1 mm-3 mm, the height may be provided within a range of approximately 3 mm-10 mm and the length may be provided within a range of approximately 7 mm-21 mm, although other ranges are also possible. More particularly, the suspension assembly is preferably made of a flexible material having properties such as a flexural modulus approximately up to 2250 MPa as per ISO 178 testing standard, which enable bending or moving when acted upon by the user's applied force. The flexible properties of the material also permit the inner frame to be moved by the user with comfortable force such the user experiences minimal fatigue or discomfort when styling, de-tangling or volumizing hair for a long duration of time. Such material preferably is also durable such that it may repeatedly moved with minimal material deformation during repeated use.

With reference by way of example in FIGS. 5 and 9-10, the relative size of the suspension member to the respective well is also important. A distance T between the prong side edge and the prong suspension member may be set to an approximate minimum distance of 1 mm so as to allow for expansion of the suspension member when it is compressed, for example, along the longitudinal axis. At maximum compression, the prong suspension member may also contact its flanking prong side edges, which side edges may also provide stability during use. Similarly, a minimum distance T may be set for the base suspension member, such as base suspension member 404 in FIG. 10, and its adjacent surfaces of the inner and outer frames.

Turning back to FIGS. 1-2, the apparatus 10 may also include a control member, generally at 500, disposed at the proximal end 86 of the inner frame 16. The control member 500 preferably has a user receiving surface 502 that is adapted for receiving at least one finger of the user. The control member permits the user to manipulate the inner frame movement so as to relatively move the inner frame with respect to the outer frame. The control member 500 may be formed on the inner frame bottom surface 90 having a contoured shape, front projection or protruding lever, as best seen in FIG. 2. The control lever may extend along the longitudinal axis 60 towards the handle 12 and may have a minimum width in the lateral axis 134, and/or textured ornamentation or ribbed surface, to facilitate engagement by a user's finger or a portion thereof, particularly a thumb, or a portion of the user's hand. As shown in FIG. 2, a portion of the control member 50 may extend along transverse axis 134 and protrude from one or both of the front and/or back surfaces 114 (such as control member back portion 115) of the inner frame for ease of manipulating by various parts of the user's hand. Other control member designs or types of projecting shapes are also possible.

Figure 4:
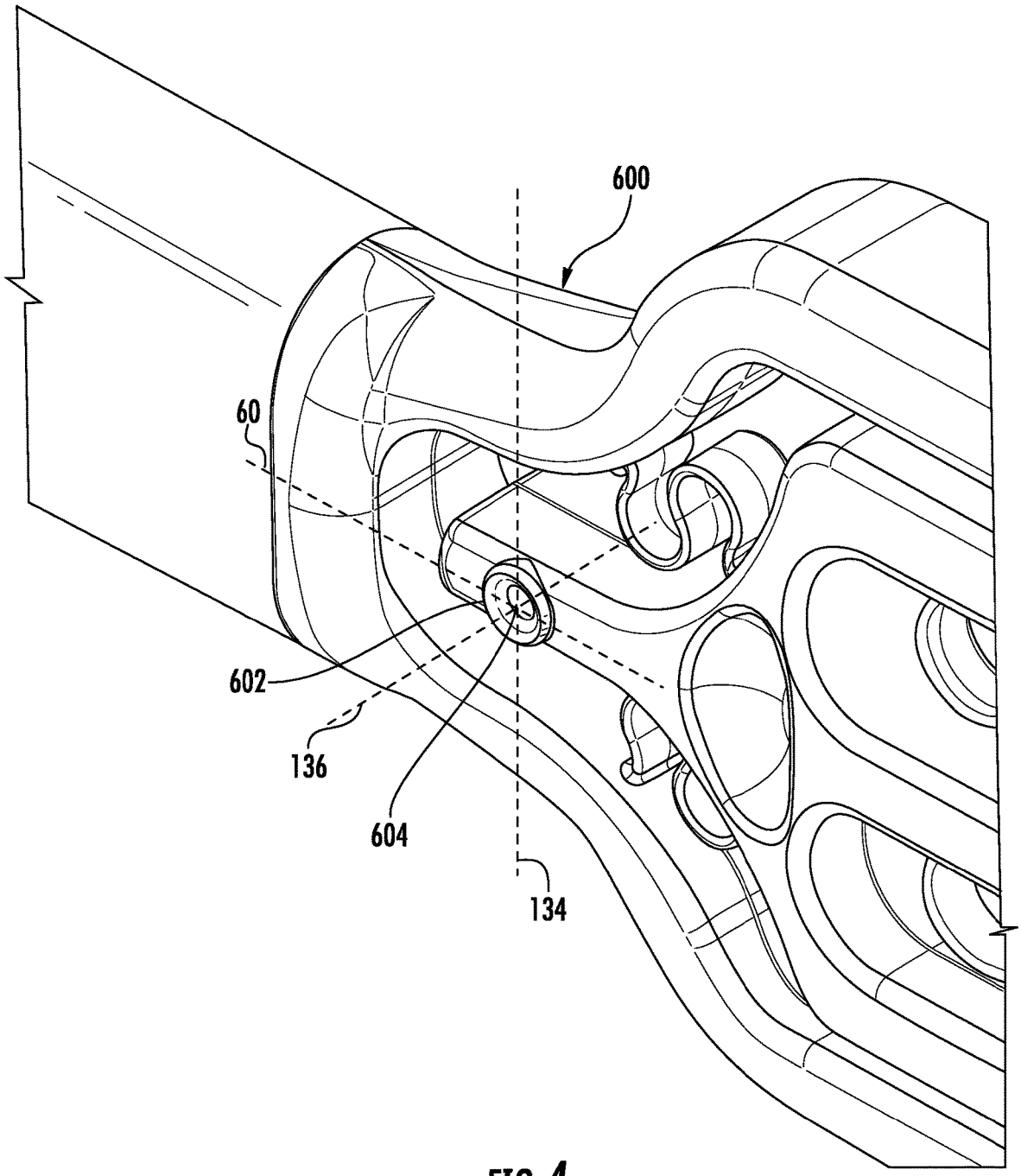
FIG. 4 is an enlarged perspective view in accordance with another embodiment of the present disclosure (with portions of the apparatus removed) showing an alternate control member, and more particularly showing a protrusion or button having a contoured surface, for receiving a user's finger.

By way of example and not limitation, in FIG. 4, another control member 600 may include a substantially circular protrusion 602, such as a button or other similar design, extending transversely from the inner frame front surface 114 and/or include a recessed inner depression 604 to provide a contour from receiving a user's finger, hand or a portion thereof. Other combinations and/or combinations thereof for the control members design are also possible.

Various processes may be used to manufacture the hair brush apparatus such as but not limited to various molding processes. Injection molding may, but not exclusively, be used whereby one or more materials are injected into a mold and formed either in one step from a single injection or a composite of steps that form the article from multiple injections and/or from one or more materials that are over-molded on each other. The articles further may be made or molded separately and assembled together using various techniques. Various materials may be used and selected from one or more of types of plastic, such as but not limited to nylon, and/or TPE, as well as other materials such as metal, wood or the like. Various combinations of materials also be used together. By way of example and not limitation, at least one of the inner frame, outer frame and the suspension assembly may be made of using an injection molding process with one or more injection gates with any of the above described materials or a combination thereof although other manufacturing methods are also possible.

Operation

A further aspect of the present disclosure allows relative movement between the inner and outer frames 14, 16 in as many as three dimensions or along three axes 60, 134, 136. Although movement will be described in terms of a fixed or stationary outer frame and a movable inner frame, it is understood that either frame may be fixed (relative to the user's hand) to provide relative movement of the other frame. When in use, the user may hold the handle of the apparatus and use one or more fingers and/or other portions of his/her hand, to move the inner and outer frames relative to each other. More particularly, the user can move the control member 500 along the first or longitudinal axis, the second axis or lateral axis and/or the third or transverse axis and/or a combination thereof to allow movement of the inner frame in three-dimensions.

Preferably, such movement occurs along at least two axes, and even more preferably, back and forth along three axes shown at X, Y, Z in FIGS. 1-2. It will be understood that relative movement of the inner and outer frames also moves the bristles that are attached to each frame so that when applied to hair, the bristles of the movable frame moves with respect to the other frame's bristles in longitudinal, lateral and transverse directions in a myriad of combinations in three dimensional space. For example, along the X-axis, the inner frame may move either toward the left side (with base suspension member 142 under compression and base suspension member 144 under expansion) or towards the right side (with base suspension member 144 under compression and base suspension member 142 under expansion) or anywhere in between. With respect to movement along the Y-axis, the inner frame may move proximally towards the handle 12, with base and prong suspension members 142, 144, 150, 152 under compression and prong suspension members 146, 148 under expansion, or may move distally with a reversal of forces acting upon such members. With respect to movement along the Z-axis, each of the base and prong suspension members 142, 144, 146, 148, 150, 152 will undergo tension forces as they flex to permit movement of the inner frame away from the handle 12 or compression forces as it is moved toward the handle. Any combination of these movements is possible to permit movement in three dimensions in response to pressing force by the user. The type of movement may also include various flexing of the material along all or a portion of its length such as, but not be limited to, all or a portion of the inner frame twisting relative to the outer frame. Other variations of movement are possible without departing from the scope of the claims.

When used to brush hair, the individual hair strands or portions thereof that are between the movable frame bristles also move in three dimensions relative to the hair strand/portion counterparts that are between the fixed frame bristles. During use, the relative movement between the inner and outer frames may achieve various styling techniques such as for de-parting (or take away parts within one's hair), de-tangling and volumizing hair. By way of one example, the relative movement of the inner frame along the X, Y and/or Z on damp hair during blow drying and/or on dry hair used in conjunction with hair spray, can add volume to hair. The user can push the movable inner frame for few seconds or until hair is dry or sprayed, and then release the movable inner frame and continue again with the same section of hair to add more volume in the same or move to another area.

To detangle hair, the user can use the hair brush apparatus of the present disclosure during normal hair brushing to achieve less stress or discomfort on the scalp while also unraveling such tangles. When the brush meets resistance or tension from tangles or thick hair, the first outer frame bristle row will flex from force. The flexed bristles will then be reinforced by the second row, located on movable inner frame, which will gently move in the opposite direction of user force, due to the flexing of the suspension assembly in response to the hair tension. Put another way, the multidirectional inner frame will move in the opposite direction of the user brushing hair until the force is equalized by the combination of flexible suspension assembly and the flexible bristles thereby alleviating uncomfortable pull forces on the hair and scalp. The user also may simultaneously facilitate unraveling of tangles by manipulation by the control member to move the inner frame in one or more directions to help to unravel or separate tangles, rather than pull such tangles. Thus, the suspension assembly is able to flex such that the inner frame moves relative to the outer frame in three dimensions to provide less hair pulling and minimize the tension placed on hair strands while simultaneously facilitating removal of tangles.

In addition, the present disclosure provides a generally planar hair brush apparatus that can move some bristles in all three dimensions while not compromising the structural integrity of the brush. More particularly, the present application provides a hair brush that is preferably made from TPE to provide resilience and reliability over time and repeated use. Such material allows for repeated movement of the inner frame relative to the outer frame back and forth along the X, Y and Z directions.

In a further aspect of the disclosure, a method for styling hair with a hair brush is provided. Such method includes providing a hair brush, such as apparatus 10, 160, 200, 300, 400 comprising an outer frame 14 extending from a handle 12 to a distal end 20 and an inner frame 16 movable relative to the outer frame. A suspension assembly 140 has at least one suspension member 142, 144-152, 162-180, 202-216, 302-316, 402-416 attaching the inner frame to the outer frame. The suspension assembly provides relative movement of the inner frame with respect to the outer frame in at least two axes of movement, such as two selected from the longitudinal, lateral and transverse axes 60, 134, 136. A control member 500 has a user receiving surface 502 that is disposed to enable relative movement of the inner frame 16. Another providing step includes a first position of the inner frame relative to the outer frame at which the inner frame is normally biased by the suspension assembly without a user applied force, such as the first position shown in FIGS. 1-2. Upon application by a user applied force, a pressing step includes pressing the control member to move the inner frame relative to the outer frame in at least two axes selected from the longitudinal, lateral and transverse axes to at least one second position. After the user releases of the pressing force, the control member 500 returns to the first or normal position and may repeat the pressing step one or more times during styling as desired. Optionally, the user may apply a second pressing force, in a different direction than the first pressing force, to manipulate the control member into a third position along one or more of the first, second and third axes. Such method may further include any one or more steps for detangling or volumizing hair, as discussed above.

While the structure and methods disclosed herein have been described in terms of preferred embodiments, it will be apparent to those of skill in the art that variations may be applied to the structure and methods and in the steps or in the sequence of steps of the methods described herein without departing from the concept, spirit and scope. More specifically, it will be apparent that a myriad of variations and modifications are possible to the preferred embodiments described herein. It is intended that such variations and modifications may be made without departing from the scope and without diminishing its intended advantages.

Other shapes or configurations may be employed for the apparatus components that permit relative movement of the frames. By way of example and not limitation, other shapes or configuration may include non-parallel, curved, circular, elliptical, square, rectangular, triangular, quadrilateral, or other multi-sided shapes than the parallel design described above. In addition, other materials or assembly variations may be used for one or more of components. It is understood that the handle, outer frame and inner frame may be formed from any one or more conventional materials heretofore used for making hair brushes. Moreover, the outer frame proximal end may be integrally manufactured with the handle, may be made of a single material or a composite of different materials. Portions of the apparatus that interact with the user, such as the handle and control member, may include materials that allow more comfortable manipulating, such as a cushioned grip for the handle, or a sensory material that provides a tactile sensation or audible sound when pressed.

All such similar substitutes and modifications apparent to those skilled in the art are deemed to be within the concept, spirit, and scope as defined by the appended claims. Further, all published documents, patents, and applications mentioned herein are hereby incorporated by reference, as if presented in their entirety.

What is claimed:

1. A hair brush apparatus comprising:

a handle;

an outer frame extending from the handle and having a proximal end attached to the handle and a distal end opposite the proximal end, the outer frame comprising:

a plurality of parallel prongs each having a plurality of bristles disposed thereon and terminating at a free end; and a plurality channels each having a closed end defining a well, each of said plurality of prongs and channels disposed in an alternating arrangement;

an inner frame having a proximal end relative to the handle and a distal end extending therefrom opposite the handle, the inner frame comprising:

a plurality of parallel prongs each having a plurality of bristles disposed thereon and terminating a free end; and a plurality channels each having a closed end defining a well, each of said plurality of prongs and channels disposed in an alternating arrangement;

said outer frame prongs interleaved with said inner frame prongs; and a suspension assembly configured to attach the inner frame to the outer frame to hold the inner frame suspendibly connected with the outer frame, the suspension assembly comprising:

at least one base suspension member affixed between the proximal end of the outer frame and a proximal end of the inner frame, wherein the base suspension member comprises a first shape; and at least one prong suspension member affixed between at least one inner frame prong end and at least one outer frame well, wherein the at least one prong suspension member comprises a second shape, wherein the first shape is an undulating shape that differs from the second shape, and wherein the suspension assembly provides relative movement of the inner frame with respect to the outer frame in three axes of movement.

2. The apparatus of claim 1, further comprising:

a control member disposed at the proximal end of the inner frame having a user receiving surface for manipulating movement of the inner frame.

3. The apparatus of claim 2, wherein the at least one base suspension member attaches the control member to the outer frame.

4. The apparatus of claim 3, wherein the at least one base suspension member comprises a quantity of two base suspension members affixed between the control member and the outer frame.

5. The apparatus of claim 2, wherein the control member includes a feature for receiving a user's finger selected from the group consisting of: a protrusion, a protruding lever, and a contoured surface.

6. The apparatus of claim 1, wherein the three axes comprise:

a longitudinal axis parallel with the handle;

a lateral axis perpendicular to the longitudinal axis; and a traverse axis, and wherein the suspension assembly provides for relative movement of the inner frame along the longitudinal and lateral axes.

7. The apparatus of claim 6, wherein the transverse axis is defined perpendicular to the longitudinal axis and the lateral axis, and wherein and said suspension assembly provides for relative movement of the inner frame along the longitudinal axis, the lateral axis, and the transverse axis.

8. The apparatus of claim 7, wherein the inner frame is movable between a first position at which the inner frame is normally biased by the suspension assembly to at least one second position at which an external force applied upon the control member by the user and enables repeated movement between said first and second positions when the external force is correspondingly removed and reapplied for as much as needed during hair styling.

9. The apparatus of claim 1, wherein at least one of said inner frame, said outer frame, and said suspension assembly comprises a material selected from the group consisting of: a plastic material, a metal material, and a wood material.

10. The apparatus of claim 1, wherein at least one of said inner frame, said outer frame, and said suspension assembly is made of TPE.

11. The apparatus of claim 1, wherein the first shape of each of the at least one base suspension member is selected from the group consisting of: a spiral shape, a U-shape, an S-shape, and a substantially circular shape, and wherein each of the at least one base suspension member is selected from the group consisting of: a spring, a flexible hinge, and one or more flexible sections.

12. The apparatus of claim 1, wherein the second shape of each of the at least one prong suspension member is selected from the group consisting of: a spiral shape, a U-shape, an S-shape, and a substantially circular shape, and wherein each of the at least one prong suspension member is selected from the group consisting of: spring, a flexible hinge, and one or more flexible sections.

13. The apparatus of claim 1, wherein a quantity of the plurality of channels of the distal end of the outer frame is two such that the plurality of channels of the outer frame each define the well to result in a quantity of two wells, and wherein the at least one prong suspension member is configured to attach each of the two wells to the corresponding inner frame prong end.

14. The apparatus of claim 1, wherein a quantity of the plurality of channels of the distal end of the outer frame is three such that the plurality of channels of the outer frame each define the well to result in a quantity of three wells, and wherein the at least one prong suspension member is configured to attach each of the three wells to the corresponding inner frame prong end.

15. The apparatus of claim 1, wherein a quantity of the plurality of channels of the proximal end of the inner frame is three such that the plurality of channels of the inner frame each define the well to result in a quantity of two wells, and wherein the at least one prong suspension member is configured to attach each of the two wells to the corresponding outer frame prong end.

16. The apparatus of claim 15, wherein a middle portion of the inner frame is free from attachment to the outer frame, the middle portion extending between the inner frame prongs ends and outer frame prong ends, and excludes any attachment to a portion of the suspension assembly.

17. A hair brush apparatus comprising:

a handle;

an outer frame extending from the handle and having a proximal end attached to the handle and a distal end opposite the proximal end, the outer frame comprising:

a plurality of parallel prongs each having a free end; and a plurality channels each having a closed end defining a well, each of said plurality of prongs and channels disposed in an alternating arrangement;

an inner frame having a proximal end relative to the handle and a distal end extending therefrom opposite the handle, the inner frame comprising:

a plurality of parallel prongs each having a free end; and a plurality channels each having a closed end defining a well, each of said plurality of prongs and channels disposed in an alternating arrangement;

said outer frame prongs interleaved with said inner frame prongs;

a suspension assembly configured to attach the inner frame to the outer frame to hold the inner frame suspendibly connected with the outer frame, the suspension assembly comprising:

at least one base suspension member affixed between the proximal end of the outer frame and a proximal end of the inner frame, wherein the base suspension member comprises a first shape; and at least one prong suspension member affixed between at least one inner frame prong end and at least one outer frame well, wherein the at least one prong suspension member comprises a second shape, wherein the first shape is an undulating shape that differs from the second shape, and wherein the suspension assembly provides relative movement of the inner frame with respect to the outer frame in three axes of movement; and a control member disposed at the proximal end of the inner frame having a user receiving surface for manipulating movement of the inner frame, wherein the at least one base suspension member is configured to attach the control member to the outer frame, wherein said three axes comprise: a longitudinal axis parallel with the handle, a lateral axis perpendicular to the longitudinal axis, and a transverse axis perpendicular to the longitudinal axis and the lateral axis, and wherein the suspension assembly provides for relative movement of the inner frame along the longitudinal axis, the lateral axis, and the transverse axis.

18. The apparatus of claim 17, wherein a quantity of the plurality of channels of the distal end of the outer frame is two such that the plurality of channels of the outer frame each define the well to result in a quantity of two wells, wherein the at least one prong suspension member is configured to attach each of the two wells to the corresponding inner frame prong end, wherein a quantity of the plurality of channels of the proximal end of the inner frame is three such that the plurality of channels of the inner frame each define the well to result in a quantity of two wells, and wherein the at least one prong suspension member is configured to attach each of the two wells to the corresponding outer frame prong end.

19. The apparatus of claim 18, wherein a middle portion of the inner frame is free from attachment to the outer frame, the inner frame middle portion extending between the inner frame prongs ends and outer frame prong ends, and excludes any attachment to a portion of the suspension assembly.

* * * * *